US008331582B2

(12) United States Patent
Steele

(10) Patent No.: US 8,331,582 B2
(45) Date of Patent: Dec. 11, 2012

(54) METHOD AND APPARATUS FOR PRODUCING ADAPTIVE DIRECTIONAL SIGNALS

(75) Inventor: Brenton Robert Steele, Blackburn South (AU)

(73) Assignee: Wolfson Dynamic Hearing Pty Ltd, Victoria (AU)

( * ) Notice: Subject to any disclaimer, the term of this patent is extended or adjusted under 35 U.S.C. 154(b) by 1073 days.

(21) Appl. No.: 10/596,122

(22) PCT Filed: Aug. 11, 2004

(86) PCT No.: PCT/AU2004/001071
§ 371 (c)(1),
(2), (4) Date: Jun. 28, 2006

(87) PCT Pub. No.: WO2005/055644
PCT Pub. Date: Jun. 16, 2005

(65) Prior Publication Data

US 2007/0014419 A1 Jan. 18, 2007

(30) Foreign Application Priority Data

Dec. 1, 2003 (AU) ..... 2003906650

(51) Int. Cl.
*H04R 3/00* (2006.01)

(52) U.S. Cl. ..... 381/92; 381/313

(58) Field of Classification Search ..... 381/312–322, 381/92, 122, 91, 356, 104–109, 71.1–71.14, 381/94.1–94.9; 704/233–244
See application file for complete search history.

(56) References Cited

U.S. PATENT DOCUMENTS

| | | | |
|---|---|---|---|
| 3,946,168 | A | 3/1976 | Preves |
| 3,975,599 | A | 8/1976 | Johanson |
| 3,983,336 | A | 9/1976 | Malek |
| 4,041,251 | A | 8/1977 | Kaanders |
| 4,142,072 | A | 2/1979 | Berland |

(Continued)

FOREIGN PATENT DOCUMENTS

WO WO 01/95666 A2 12/2001

(Continued)

OTHER PUBLICATIONS

Luo, Fa-Long et al., "Adaptive Null-Forming Scheme in Digital Hearing Aids," IEEE Transactions on Signal Processing, 2002, pp. 1583-1590, vol. 50, No. 7.

(Continued)

*Primary Examiner* — Vivian Chin
*Assistant Examiner* — Fatimat O Olaniran
(74) *Attorney, Agent, or Firm* — Christie, Parker & Hale, LLP.

(57) ABSTRACT

The invention relates to adaptive directional systems, and more particularly to a method and apparatus for producing adaptive directional signals. The invention may be applied to the provision of audio frequency adaptive directional microphone systems for devices such as hearing aids and mobile telephones. The method involves constructing the adaptive directional signal (46) from a weighted sum of a first signal (42A) having an omni-directional polar pattern and a second signal (42B) having a bi-directional polar pattern, wherein the weights are calculated to give the combined signal a constant gain in a predetermined direction and to minimize the power of the combined signal. The method has particular application in producing signals in digital hearing aids, the predetermined direction being in the forward direction with respect to the wearer.

27 Claims, 4 Drawing Sheets

U.S. PATENT DOCUMENTS 4,712,244 A 12/1987 Zwicker
4,751,738 A 6/1988 Widrow
4,768,613 A 9/1988 Brown
4,773,095 A 9/1988 Zwicker
4,904,078 A 2/1990 Gorike
5,033,090 A 7/1991 Weinrich
5,214,709 A 5/1993 Ribic
5,289,544 A 2/1994 Franklin
5,325,436 A 6/1994 Soli
5,384,843 A * 1/1995 Masuda et al. ..... 379/391
5,463,694 A * 10/1995 Bradley et al. ..... 381/92
5,473,684 A * 12/1995 Bartlett et al. ..... 379/395
5,473,701 A 12/1995 Cezanne
5,502,747 A 3/1996 McGrath
5,627,799 A * 5/1997 Hoshuyama ..... 367/121
5,737,430 A 4/1998 Widrow
5,748,743 A 5/1998 Weeks
5,757,932 A 5/1998 Lindemann
5,757,933 A 5/1998 Preves
5,764,778 A 6/1998 Zurek
5,793,875 A 8/1998 Lehr
5,828,757 A 10/1998 Michalsen
5,878,147 A 3/1999 Killion
5,949,889 A 9/1999 Cooper
6,068,589 A 5/2000 Neukermans
6,069,963 A 5/2000 Martin
6,075,869 A 6/2000 Killion
6,101,258 A 8/2000 Killion
6,134,334 A 10/2000 Killion
6,151,399 A 11/2000 Killion
6,264,603 B1 7/2001 Kennedy
6,272,229 B1 8/2001 Baekgaard
6,285,771 B1 9/2001 Killion
6,327,370 B1 12/2001 Killion
6,339,647 B1 1/2002 Andersen
6,385,323 B1 5/2002 Zoels
6,389,142 B1 5/2002 Hagen
6,405,163 B1 * 6/2002 Laroche ..... 704/205
6,421,448 B1 7/2002 Arndt
6,424,721 B1 7/2002 Hohn
6,449,216 B1 9/2002 Roeck
6,522,756 B1 2/2003 Maisano
6,539,096 B1 3/2003 Sigwanz
6,584,203 B2 6/2003 Elko
6,741,714 B2 5/2004 Jensen
6,751,325 B1 * 6/2004 Fischer ..... 381/313
7,076,072 B2 * 7/2006 Feng et al. ..... 381/313
7,120,262 B2 * 10/2006 Klinke ..... 381/92
7,242,781 B2 * 7/2007 Hou ..... 381/92
7,324,649 B1 * 1/2008 Knapp et al. ..... 381/313
7,471,798 B2 * 12/2008 Warren ..... 381/92
2001/0028718 A1 10/2001 Hou
2001/0028720 A1 10/2001 Hou
2002/0034310 A1 3/2002 Hou
2002/0041695 A1 4/2002 Luo

FOREIGN PATENT DOCUMENTS

WO WO 01/97558 A2 12/2001
WO WO 2004/057914 A1 7/2004

OTHER PUBLICATIONS

Teutsch, Heinz and Elko, Gary, "First- and Second-Order Adaptive Differential Microphone Arrays," 7th International Workshop on Acoustic Echo and Noise Control, 2001, pp. 35-38, Darmstadt, Germany.

Ricketts, Todd and Henry, Paula, "Evaluation of an Adaptive, Directional-Microphone Hearing Aid," International Journal of Audiology, 2002, pp. 100-111, vol. 41, No. 2.

European Examination Report for corresponding European Patent Application No. 04 761 108.2, dated Apr. 11, 2011, 5pp.

* cited by examiner

METHOD AND APPARATUS FOR PRODUCING ADAPTIVE DIRECTIONAL SIGNALS

FIELD OF THE INVENTION

The invention relates to adaptive directional systems, and more particularly to a method and apparatus for producing adaptive directional signals. The invention may be applied to the provision of audio frequency adaptive directional microphone systems for devices such as hearing aids and mobile telephones.

BACKGROUND OF THE INVENTION

In this specification, where a document, act or item of knowledge is referred to or discussed, this reference or discussion is not an admission that the document, act or item of knowledge or any combination thereof was at the priority date:

(i) part of common general knowledge; or (ii) known to be relevant to an attempt to solve any problem with which this specification is concerned.

An omni-directional microphone converts sound waves emanating from all directions into electrical signals to be passed to an output. A directional microphone system is typically constructed from two or more omni-directional microphones, in a configuration that attenuates sounds emanating from certain directions and enhances sounds emanating from other directions.

The directionality of a particular directional microphone system in the horizontal plane is represented graphically by a polar pattern, where the direction directly in front of the microphone is shown at 0°, and the direction directly behind the microphone is shown at 180°. The plot of a polar pattern represents gain as a function of the direction of sound arrival, the gain for any given direction represented by the distance from the centre of the polar coordinates.

Some of the more common polar patterns are illustrated in FIG. 1, which shows an omni-directional polar pattern 10 (with no nulls), a bi-directional polar pattern 12 (with nulls at 90° and 270°), a cardioid polar pattern 14 (with a null at 180°) and a super-cardioid polar pattern 16 (with nulls at approximately 135° and 225°)

Directional microphone systems have been employed in the past in hearing aids to improve the signal-to-noise ratio. It is assumed the sound that the listener wishes to hear emanates from a forward direction, ie the direction in front of the listener, and so the directional microphone system is designed to provide a maximum gain for sounds emanating from this direction whilst attempting to reduce the sounds emanating from other directions.

Conventionally, directional microphone systems are fixed, meaning that the output signal has a fixed polar pattern. Fixed directional microphones traditionally comprise two spaced omni-directional microphones, a delay element and a difference element, and are configured to provide a fixed directional signal by subtracting the delayed signal from the original signal.

Examples of fixed directional microphone systems that do not utilise a delay element are disclosed in U.S. Pat. No. 5,463,694 and U.S. Pat. No. 4,712,244. These directional systems instead use a particular combination of averaging, amplifying, summing, subtracting and integrating elements that operate on the signals from the microphones to construct the fixed directional signal pattern.

As the output from a fixed directional microphone system is a polar pattern with a stationary null, it can only maximally attenuate sounds emanating from a particular direction (although sounds from directions close to the null will receive some attenuation). In many practical situations this can represent a significant compromise on the performance of the system. If noise emanates from a direction different to that of the null, or from multiple directions (which would require a compromise null position), or if there is a moving noise source, a reduced signal-to-noise ratio will result.

More complex 'adaptive' directional microphone systems have been developed to overcome shortcomings in directional microphone systems. Such systems have the ability to construct varying polar patterns which are able to dynamically 'steer' a null to attenuate signals representing sounds emanating from different directions, or from moving sources.

Known adaptive directional microphone systems are in fact extensions of conventional fixed systems, and typically utilise a variable delay element to vary the polar patterns, and thus provide adaptive directional signals. The architecture of such an adaptive directional microphone system is illustrated in FIG. 2. Front 20 and rear 22 omni-directional microphones transduce sound waves into front 21 and rear 23 electrical signals.

When a sound wave arrives from the forward direction, it reaches the front microphone first, and hence the rear signal 23 is a delayed version of the front signal 21. Likewise, if the sound arrives from behind, the front signal 21 is a delayed version of the rear signal 23. If the sound arrives from the side, there is no delay between the two signals 21 and 23. In short, the delay between the two signals is dependent on the angle of arrival of the sound wave. A variable delay element 24, coupled to the rear microphone 22, is used to match the delay corresponding to the desired cancellation direction. This produces a delayed rear signal 25. This signal 25 is received by a difference element 26 also coupled to the front microphone 20, configured as shown to output the difference between signals 21 and 25 to produce the directional output signal 30. As will be understood by those skilled in the art, the adaptive nature of this system is provided by a feedback loop, the adaptive directional signal 30 feeding back to an optimising algorithm element 28, which in turn provides an optimised delay value 29 to the variable delay element 24 used in producing delayed rear signal 25. The system is therefore designed to iteratively converge to a desired solution, in accordance with the algorithm implemented by element 28.

Various examples of known adaptive directional microphone systems that use variable delay elements are described in U.S. Pat. No. 5,757,933, US-2001/0028720, US-2001/0028718, U.S. Pat. No. 6,539,096 and U.S. Pat. No. 6,339,647. The main disadvantages of these systems are the complexity involved in implementing the variable delay element, along with the possible instability introduced through the use of a feedback structure.

Adaptive directional microphone systems that do not employ variable delay elements are also known, and examples of such systems are described in WO-01/97558 and US-2003/0031328. Both systems utilise two fixed delay elements to generate a forward-facing and a backward-facing cardioid polar pattern, which respectively represent an 'enhanced signal' and an 'enhanced noise'. The enhanced noise and enhanced signal are then combined to produce an adaptive directional signal. An optimisation algorithm is used to find the ideal combination of the two signals to give maximum noise rejection. A major disadvantage of these adaptive directional systems is again their reliance on delay elements, in this case multiple fixed delay elements. As discussed above, these elements can be very difficult to implement in hardware, or require a specially designed allpass filter, which significantly increases the processing requirements of the system, particularly when implemented using a digital signal processor.

Adaptive directional microphone systems have also been developed that, instead of being continuously variable, simply select an output from a range of signals that have been implemented. One of the simplest approaches is described in U.S. Pat. No. 6,327,370, and involves using a fixed directional signal and an omni-directional signal, with a selection between the signals based on prescribed criteria such as ambient noise level. The idea has been extended in the teaching of U.S. Pat. No. 6,522,756, which includes a greater number of directional signals for selection. Such 'signal selection' systems are quite simple and can perform well, however for adequate performance they require many signals to be generated simultaneously, greatly increasing the demands on hardware and processing power. In addition, the limited choice of beam types signifies a discontinuous response, such that a signal with an optimum polar pattern cannot always be found.

There remains a need to provide an improved, or at least an alternative, method and apparatus for producing adaptive directional signals.

SUMMARY OF THE INVENTION

According to one form of the invention a method for producing an adaptive directional signal is provided, the method including constructing the adaptive directional signal from a weighted sum of a first signal having an omni-directional polar pattern and a second signal having a bi-directional polar pattern, wherein the weights are calculated to give the combined signal a constant gain in a predetermined direction and to minimise the power of the combined signal.

By minimising the power of the constructed adaptive directional signal, the amplitude of signals received from directions other than the predetermined direction is minimised.

The directional signal is produced by the optimised weights that in effect, adaptively vary the relative contributions of the first and second signals, to thereby minimise or eliminate the contribution of signals emanating from directions other than the predetermined direction. Thus it will be realised that the polar pattern of the combined signal will vary in response to changes in the first and second signals, whilst providing a constant gain for signals that emanate from the predetermined direction. For example, the adaptive directional signal may have a cardioid, super-cardioid, or even an omni-directional polar pattern, depending on the calculated weightings.

In a preferred embodiment, the first and second signals are derived from signals produced by two spaced omni-directional microphones, a front and a rear microphone, and said predetermined direction is the forward direction along the microphone axis. The method of the present invention is also applicable to signals produced from an array of more than two microphones.

Preferably, the second signal is provided by the difference between signals produced by two spaced omni-directional microphones, without the use of a delay element.

In accordance with this embodiment, the method may further include processing the second signal by means of an integrator element or an integrator-like filter before constructing the combined signal, thereby compensating for the attenuation of low frequencies and phase shifts introduced in the subtraction of the two omni-directional signals.

Preferably, the microphones are matched, which can be accomplished by using physically matched microphones or by employing a gain element to match the microphone outputs.

A weight may be calculated in any convenient manner that provides for the constant gain of the combined polar pattern in the forward direction and minimises the power of the combined signal. Typically the constant gain is provided by imposing a consent that the first signal weight and the second signal weight add to one.

In preferred embodiments the weights are calculated in a non-iterative manner, such as by solving the following equation:

$$a = \frac{\sum y^2 - \sum xy}{\sum x^2 - 2\sum xy + \sum y^2}$$

Where:

a=weight for the first signal (1−a)=weight for the second signal x=first signal sample y=second signal sample.

A weight may be calculated for a frame of predetermined length consisting of N first signal samples and N second signal samples. The length of the frame (N) generally depends upon the environment of application of the method, however a suitable frame length for audio frequency signals is 32 or 64 samples long. The weighting factor may change significantly from frame to frame, so the series of weight values may also be filtered or smoothed to minimise frame to frame variation in the weight (which may otherwise be heard as audible artifacts).

In another embodiment weights are calculated continuously for each first signal sample and second signal sample. This is achieved by calculating $x^2$, $y^2$ and xy for each sample and adding them to the appropriate running sum. A leaky integrator (an integrator having a feedback coefficient slightly less than one) can be used to perform the running sum in order to prevent overflows and to ensure that the system's 'memory' is not too long. This embodiment allows a new weighting factor to be calculated every time that a new sample is available, rather than having to wait for a whole frame of samples.

In another embodiment, the first and second signals (ie the variables x and y in the form described above) can be frequency domain samples rather than time domain samples. In this case the optimisation of the weighting factor (a) can be calculated as above, but with the added advantage that the weighting factor can be calculated and applied to several independent subsets of frequency domain samples (giving different directional responses at different frequencies). Also, if some frequencies are deemed to be more important to suppress than others, they can be given a higher weighting before calculating the weighting factor (a). This allows the system to focus on rejecting only (say) speech-type sounds, or machinery sounds. A similar approach can be applied in the time domain through the use of time domain filters.

The sums used for calculating the weighting factor a can also be used to detect particular conditions that require a different signal processing approach. For example, if $\Sigma x^2$ is particularly small, then the environment is quiet, which suggests that an omni-directional response is more suitable than a directional response. In this case a simple threshold test could be performed to decide on the appropriate strategy.

The invention is based on the realisation that an adaptive directional signal of varying polar pattern can be constructed from a weighted sum of an omni-directional and a bi-directional polar pattern which can be easily generated without the use of delay elements. Surprisingly, despite the simplicity of the system of the invention, theoretical analysis and test results have demonstrated extremely good performance in terms of noise reduction and signal enhancement.

According to a further form of the invention, an apparatus for producing an adaptive directional signal is provided, the apparatus including:

means for producing a first signal having an omni-directional polar pattern and a second signal having a bi-directional polar pattern; and means for constructing the adaptive directional signal from a weighted sum of the first and second signals, wherein the weights are calculated to give the combined signal a constant gain in a predetermined direction and to minimise the power of the constructed adaptive directional signal.

The apparatus preferably includes means to provide said constant gain by imposing a constraint that the first signal weight and the second signal weight add to a predetermined value.

In a preferred form, the apparatus includes means for calculating the weights by solving the following equation:

$$a = \frac{\sum y^2 - \sum xy}{\sum x^2 - 2\sum xy + \sum y^2}$$

where:

a=weight for the first signal (1−a)=weight for the second signal x=first signal sample y=second signal sample.

The apparatus may include means for calculating said signal weights for a series of frames, each frame having a predetermined length consisting of N first signal samples and N second signal samples.

A filter for filtering or smoothing the series of weights may be included, to minimise frame-to-frame variation in the calculated weights.

The apparatus may include means for calculating said weights continuously for samples of said first and second signals. Further, it may include a leaky integrator to perform a running sum on said first and second signal samples in order to address issues of numerical overflow in the system memory.

Means may be included for calculating said weights so as to construct an omnidirectional combined signal when the total power in said first signal is below a certain value.

In a preferred form the apparatus may include two spaced omnidirectional microphones, a front and a rear microphone, signals from which are used for deriving said first and second signals, and said predetermined direction is the forward direction along the microphone axis. Further, means may be included for providing said second signal from the difference between signals produced by the front and rear microphones, without the use of a delay element.

The apparatus may include an integrator element or an integrator-like filter for processing the second signal before constructing the combined signal, thereby compensating for the attenuation of low frequencies and phase shifts introduced in the provision of the second signal.

Further, the apparatus may include means for amplifying the signals produced by the front and/or the rear microphone before the step of constructing the bi-directional signal, to ensure an equivalent gain between the microphones.

The invention thus serves to provide a directional response that adaptively provides the desired performance, by fixing the gain in the forward direction, while minimising the power received.

Importantly, and in contrast with the prior art, the invention avoids the need to use delay elements in providing the adaptive directional response. Instead of an iterative approach converging on a desired solution, the method of the present invention mathematically calculates the required weights to apply to combining the signal patterns in accordance with the preset constraints on a frame-by-frame or sample-by-sample basis.

The invention can also be applied to sub-band processing, providing a different adaptive response in different frequency bands.

BRIEF DESCRIPTION OF THE DRAWINGS

The invention will now be further explained and illustrated by way of a non-limiting example and with reference to the accompanying drawings, in which:

Turning to FIG. 3, the architecture of an apparatus for producing an adaptive directional signal is illustrated. The same reference numerals as those used in FIG. 2 are employed to reference similar components. The apparatus is configured as explained below to combine the output of multiple microphones to produce an adaptively directional output. Front 20 and rear 22 omni-directional microphones respectively transduce sound waves into front 21 and rear 23 signals. Microphones 20 and 22 should be matched, and this can be accomplished either by using physically matched microphones or by employing a gain element (shown at 35 in FIG. 3) to selectively match the microphone outputs. The front 20 and rear 22 microphones also include suitable analogue-to-digital converters (not shown) for providing the front 21 and rear signals 22 in a digital form.

Figure 1:
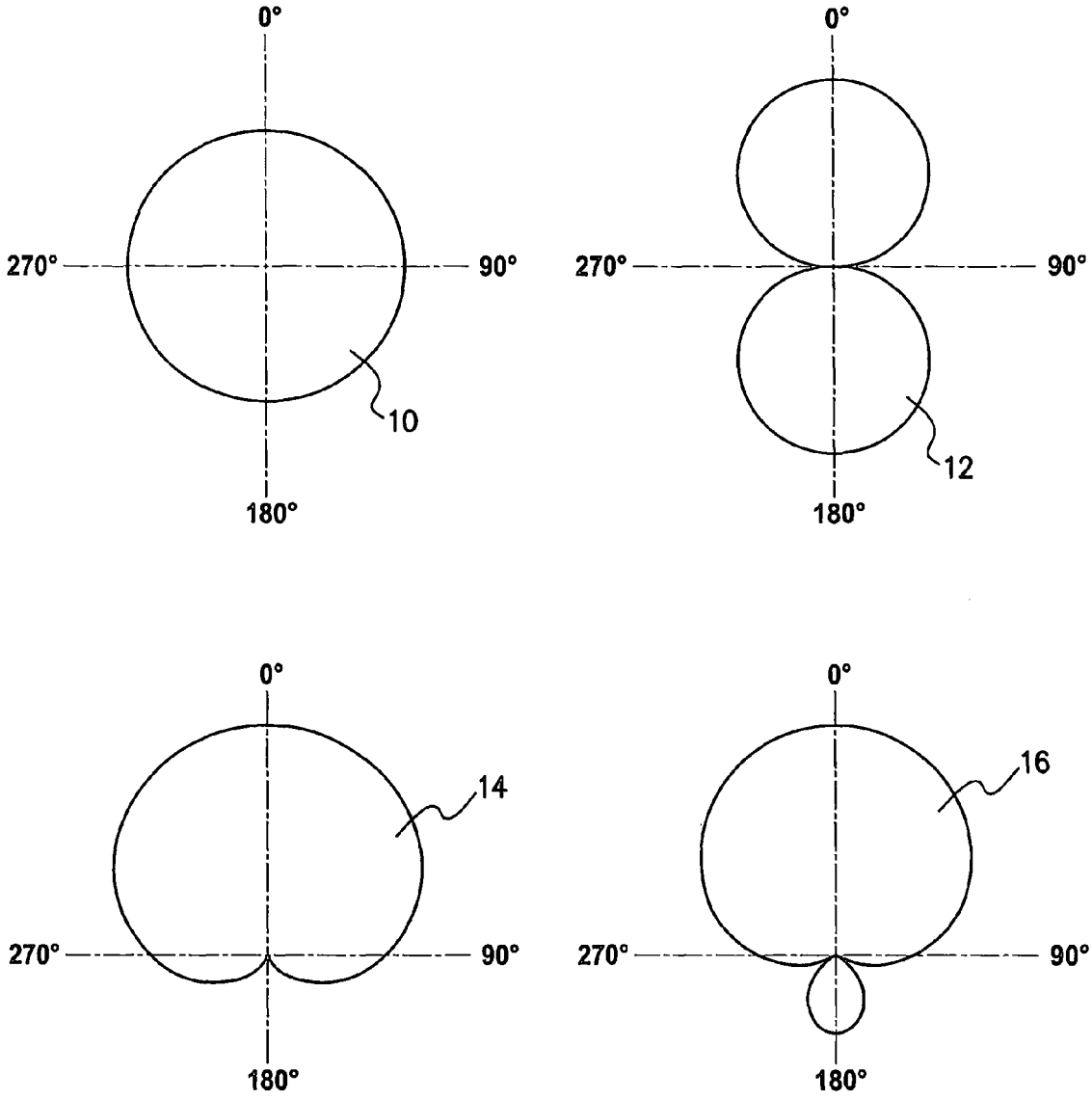
FIG. 1 is an illustration of the polar patterns of various directional signals.

As noted above, the delay between the front signal and the rear signal will depend on the angle from which the incident sound arrives. Front signal 21 and rear signal 23 are passed to a differencing element 26 for subtraction of rear signal 23 from front signal 21 to produce a signal 34 with a bi-directional polar pattern. This bipolar signal 34 attenuates sounds emanating from directions perpendicular to the axis of the front 20 and rear 22 microphones, whilst front signal 21 retains an omni-directional polar pattern.

Because the bi-directional signal 34 is generated by the difference between two delayed samples it inherently introduces a differentiated (high pass) frequency response that tends to produce undesirable attenuation of lower frequencies and a phase shift at all frequencies. To counter this effect, the bi-directional signal 34 is passed to an integrator 32 in order to give the signal 34 a flat frequency response and at the same time to automatically correct for the phase shift that is introduced during construction of the bi-directional signal. This integrator can also be replaced by a filter with a similar response to the integrator. This allows other undesirable artifacts (such as a dc offset) to be removed from the bi-directional signal.

The integrated signal 36 and the front microphone (omni-directional) signal 21 are directed to an optimiser 38 that calculates respective front signal weights 39A and rear signal weight 39B by means of an optimising algorithm described in further detail below.

The optimiser 38 calculates weights 39A and 39B subject to the constraint that the directional response of the system has a constant gain in the forward direction. Where the signals are of audio frequency and the system is employed in a hearing aid, this direction will generally be selected as the forward direction, ie, along the axis of the front 20 and rear 22 microphones. This is in accordance with the assumption noted above that the listener wishes to hear sounds emanating from the forward direction.

The constant gain in the forward directional is achieved by constraining the weights 39A and 39B to add to 1.0. This prevents sound emanating from the forward direction being attenuated in the adaptive directional signal produced by the apparatus.

It should be realised however, that the weights can be calculated to give a constant gain to signals emanating from a selected other direction, which may be useful in other applications or in accordance with other microphone configurations.

The optimisation algorithm is configured to calculate weights 39A and 39B to minimise the signal power produced. By minimising the power of the signal, the noise component (defined as signals from any direction other than the front) is minimised, thereby providing an improved signal-to-noise ratio.

The weights 39A and 39B calculated by the optimiser 38 in accordance with the optimisation algorithm are applied to respective variable gain elements 40A and 40B to which front signal 21 and bi-directional signal 36 are passed. The variable gain elements thus apply weighted gains to the samples that comprise signals 21 and 36, to produce respective weighted signals 42A and 42B.

The weighted signals 42A and 42B are then passed to a summing element 44 that outputs an adaptive directional signal 46 by summing the weighted signals 42A and 42B. The adaptive directional signal 46 is then processed further (if required) and then output to suitable output means, such as an earphone speaker (not shown).

Figure 4:
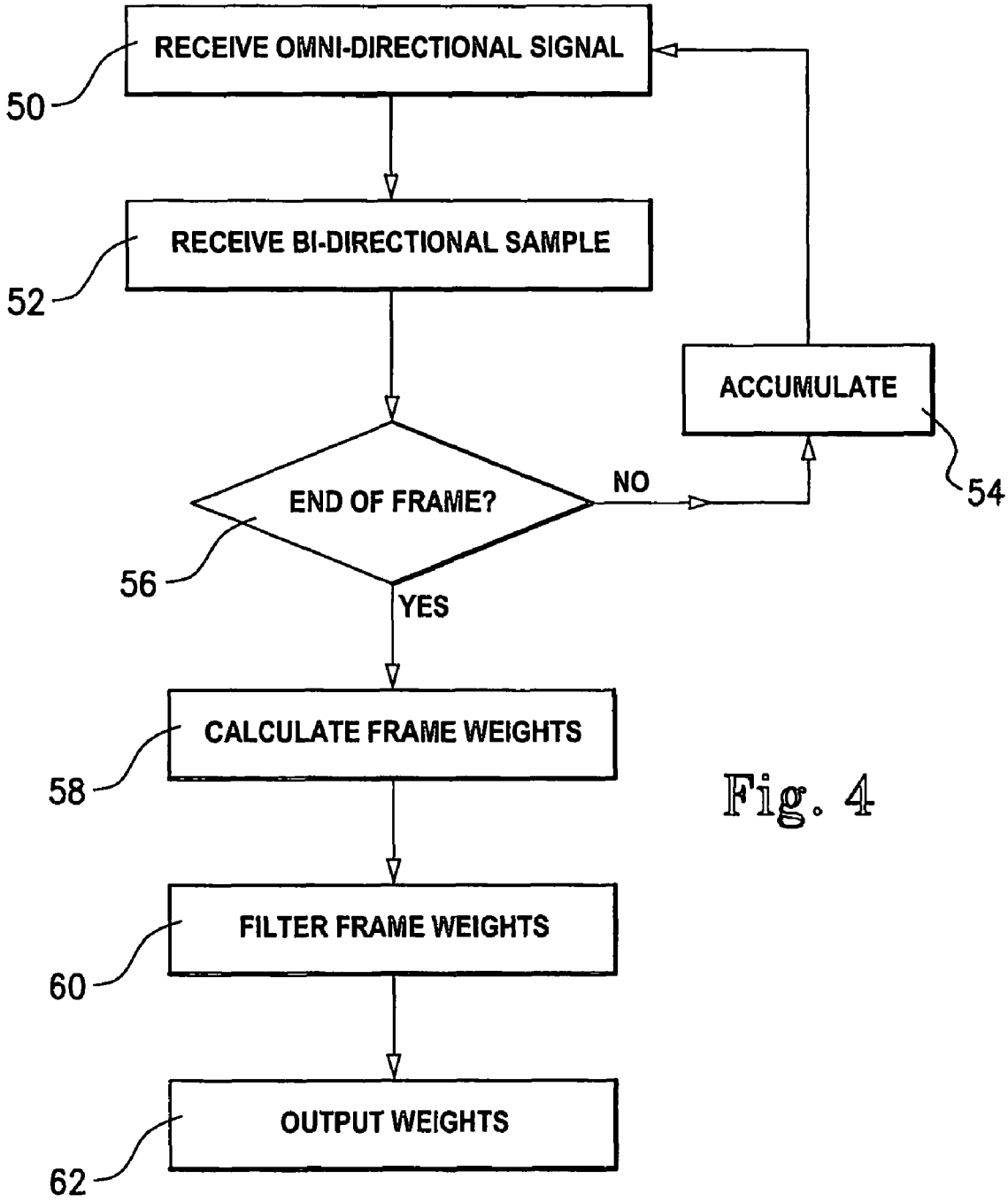
FIG. 4 is a flow chart representing a method for producing an adaptive directional signal in accordance with an embodiment of the present invention.

Turning to FIG. 4, the steps carried out by the optimiser in calculating the weights are illustrated with reference to a flow chart. In use, the optimiser is a suitable digital signal processing apparatus, as would be understood by those skilled in the art. At steps 50 and 52 the optimiser receives a sampled value of the omnidirectional signal and the bi-directional signal. In this embodiment, the weights are calculated on a frame by frame basis, with each frame being 64 samples long. Therefore, at step 56 a test is performed of whether the end of the frame has been reached. If the test is negative, step 54 is carried out and the value of the omni-directional sample and bi-directional sample are accumulated in the following summations:

$\Sigma x^2$ $\Sigma y^2$ and $\Sigma xy$ where x=the omni-directional sample series; and y=the bi-directional sample series.

If the test is positive, the weight for the omni-directional signal a is calculated at step 58 using the accumulated sums in the following formula:

$$a = \frac{\sum y^2 - \sum xy}{\sum x^2 - 2\sum xy + \sum y^2}$$

As noted above, the weight is optimised subject to the constraint that there is to be a constant gain in the forward direction, which is imposed by setting the sum of the omni-directional and bi-directional weights equal to one. From this, the bi-directional weight is simply calculated as (1−a). Also, as noted previously, other criteria can be applied in calculating a, such as forcing it to 1 (i.e. an omni-directional response) when in a quiet environment (if $\Sigma x^2$ is small).

The derivation of the above formula is found by using the constraint that the total power of the output adaptive directional signal is to be minimised. Therefore:

$$\text{Energy}=\Sigma(ax(t)+(1-a)y(t))^2$$

Differentiating with respect to a to find the point of minimum energy gives:

$$\begin{aligned}\frac{d\,Energy}{da} &= 0\\ &= 2a\left(\sum x^2 - 2\sum xy + \sum y^2\right) + \\ &\quad 2\left(\sum xy - \sum y^2\right)\end{aligned}$$

Solving for a gives:

$$a = \frac{\sum y^2 - \sum xy}{\sum x^2 - 2\sum xy + \sum y^2}$$

Returning to the flow chart at step 60, the calculated weights are filtered to guard against excessive frame to frame variation in the weights.

In an alternative embodiment, the values $\Sigma x^2$, $\Sigma y^2$ and xy are filtered prior to the calculation of the weights. This can be particularly useful when processing samples continuously and can be implemented efficiently if the summing operations used in the calculations of the weights are implemented as 'leaky integrators' (ie an integrator with a feedback coefficient slightly less than one). This allows a new weighting factor to be calculated every time a new sample is available, rather than having to wait for a whole frame of samples.

The final step 62 in the process illustrated is the outputting of the weights 42A and 42B.

In a further alternative embodiment the weights may be calculated over multiple frames, or continuously.

Figure 5:
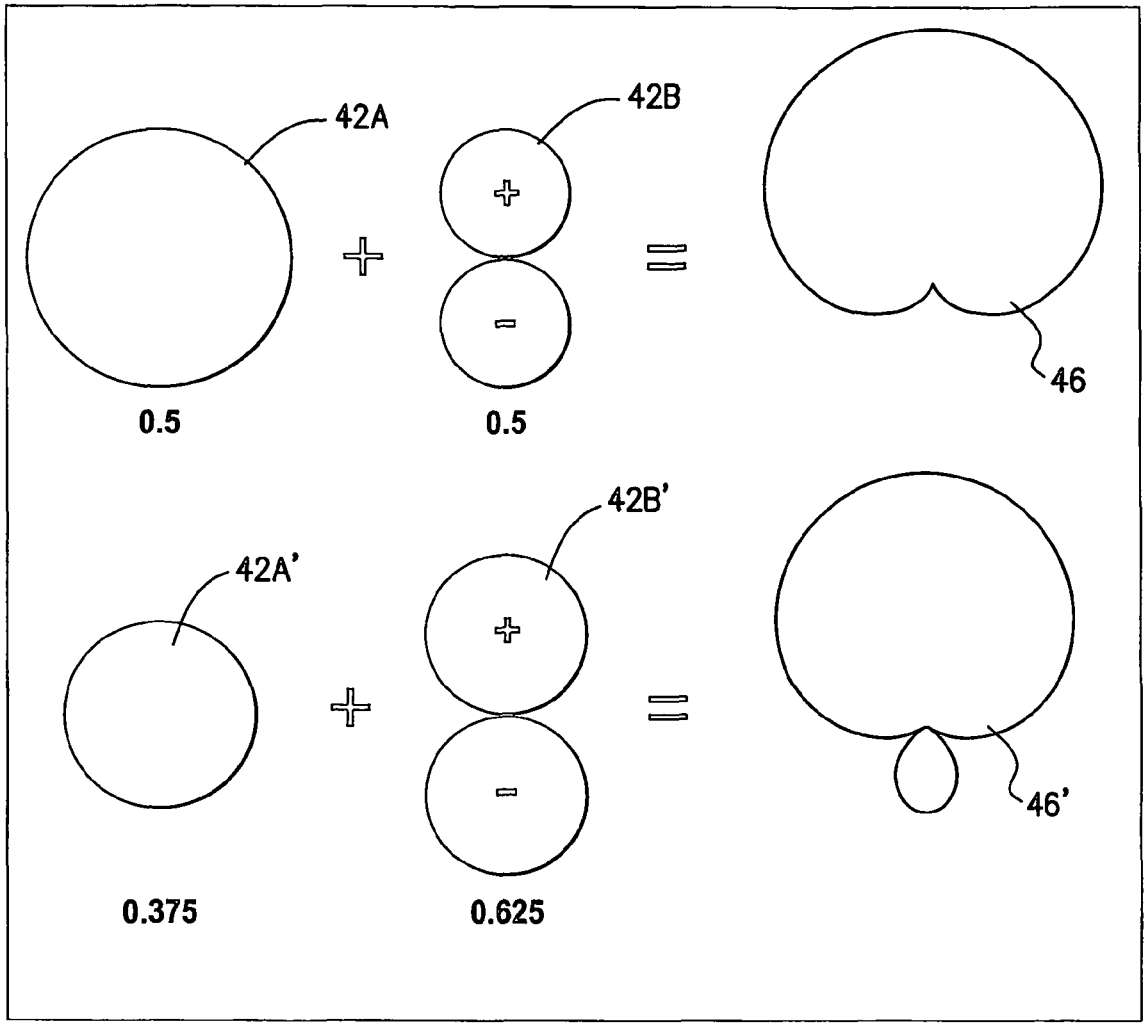
FIG. 5 illustrates two example adaptive directional signals produced by implementing the method of the present invention.
Figure 2:
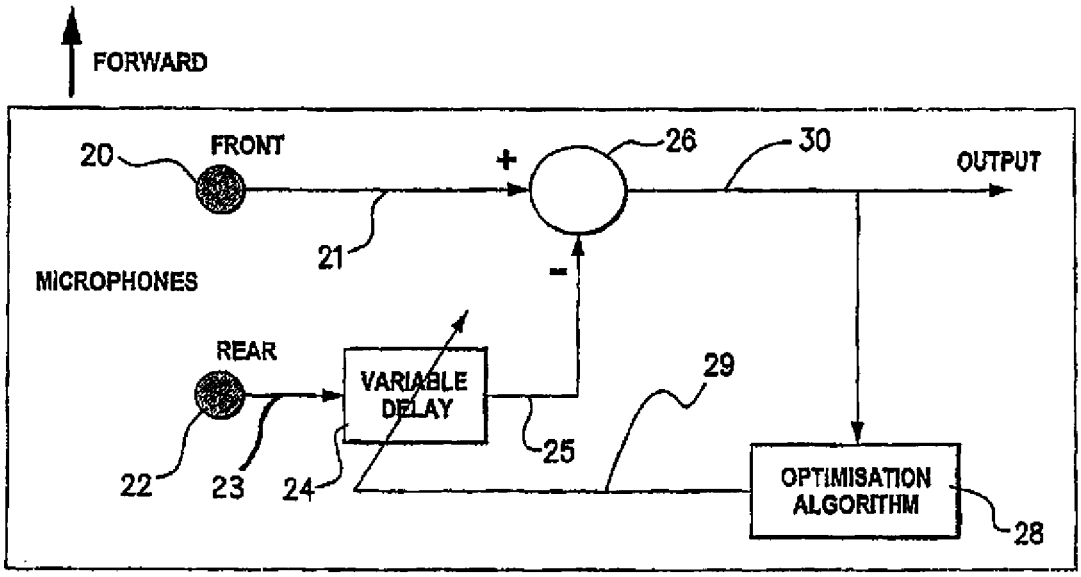
Fig. 2 Prior Art
Figure 3:
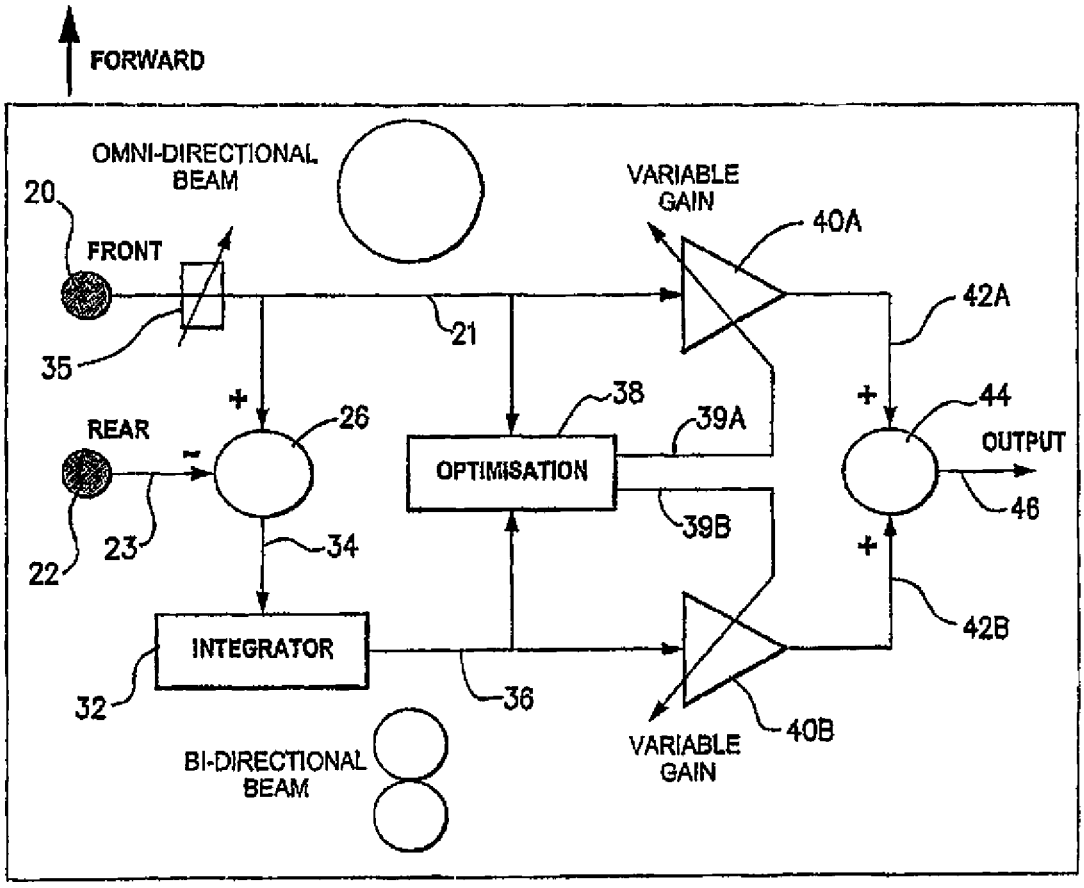

Turning to FIG. 5, the effect of different omni-directional and bi-directional weights on the polar pattern of the output adaptive directional signal produced (under the constraints defined above) is illustrated. The directional signal (46 and 46' in FIG. 5) is constructed from the weighted contributions of the omni-directional 42A/42A' and bi-directional signals 42B/42B'.

For example, an omni-directional weight of 0.5 and a bi-directional weight of 0.5 produce a directional signal 46 having a cardioid polar pattern as shown. The equal weighting used means that the rear lobe of the bi-directional signal exactly cancels with the omni-directional signal in that direction.

In the second example in FIG. 5, the omni-directional signal 42A' and bi-directional signal 42B' are given weights of 0.375 and 0.625 respectively, providing a directional signal having a super-cardioid polar pattern as illustrated.

It should also be noted that in certain situations, due to the constraints imposed in accordance with the invention, an adaptive directional signal having an omni-directional polar pattern may be produced, ie when an omni-directional weight of 1 (and thus a bi-directional weight of 0) is applied. This can be the result, for example, in quiet conditions or in conditions with high levels of wind noise. In such situations the omni-directional pattern is desirable, and in contrast with prior art systems (which require to be configured to switch to an omni-directional pattern under prescribed conditions), the invention allows the system to automatically adopt such a response.

Adaptive Directional Microphone Results

The adaptive directional microphone of the present invention was implemented in a behind-the-ear hearing aid and the speech perception of eight listeners with impaired hearing was evaluated against an omnidirectional microphone and a fixed supercardioid directional microphone. The speech test used was the Hearing In Noise Test (HINT) in which a speech shaped noise is presented together with spoken sentences, and the level of the noise is adjusted until the listener recognizes 50% of the sentences correctly.

The HINT scores are expressed as signal-to-noise ratio (SNR) at the point where the listener is scoring 50% correct.

The listeners were fitted with two hearing aids, binaurally. The speech was presented from a speaker in front of the listener, and the noise was presented at three different angles (90, 135, and 180 degrees from the front), on one side only. The mean HINT scores for the eight listeners, averaged across angles were −0.38 dB for the omnidirectional microphone, −4.09 dB for the supercardioid fixed directional microphone, and −5.18 dB for the adaptive directional microphone of the present invention.

Negative SNR values indicate that the noise is louder than the speech, and hence that the adaptive directional microphone system of the present invention is allowing the listener to cope with a greater noise level.

The adaptive directional microphone performed significantly better on this test than either the omnidirectional or the supercardioid fixed directional microphone.

| Microphone | Angle for noise | HINT SNR in dB |
|---|---|---|
| adaptive | 135° | −5.12 |
| adaptive | 180° | −4.63 |
| adaptive | 90° | −5.78 |
| supercardioid | 135° | −4.54 |

| Microphone | Angle for noise | HINT SNR in dB |
|---|---|---|
| supercardioid | 180° | −2.76 |
| supercardioid | 90° | −4.96 |
| omnidirectional | 135° | −0.42 |
| omnidirectional | 180° | 2.72 |
| omnidirectional | 90° | −1.16 |

The invention can be implemented in hardware or software, and in the application to a hearing aid is preferably implemented in a DSP chip, with samples from the signals produced by each microphone used to calculate the fixed polar patterns employed as inputs to the adaptive directionality process.

Modifications and improvements to the invention will be readily apparent to those skilled in the art. Such modifications and improvements are intended to be within the scope of this invention. For example, whilst the above has been described by reference to the time domain, the teachings of the present invention apply equally in the frequency domain.

The invention claimed is:

1. A method executed by a processor for producing a combined adaptive directional signal, the method comprising:

constructing the combined adaptive directional signal from a weighted sum of a first signal weight of a first sound signal having an omni-directional polar pattern and a second signal weight of a second sound signal having a bi-directional polar pattern wherein the first signal weight and the second signal weights are calculated to give the combined signal a constant gain in a predetermined direction and to minimize power of the combined signal, wherein the weights are calculated by the processor in a non-iterative manner, and wherein the signal weights are calculated by solving the following equation:

$$a = \frac{\sum y^2 - \sum xy}{\sum x^2 - 2\sum xy + \sum y^2}$$

where a=weight for the first signal (1−a)=weight for the second signal x=first signal sample y=second signal sample.

2. A method according to claim 1, wherein the first and second signals are sampled, the signal weights being calculated for successive sets of said first and second signals samples.

3. A method according to claim 1, wherein the first and second signals are sampled, the signal weights being calculated for successive sets of said first and second signals samples, and the signal weights are calculated continuously by calculating $x^2$, $y^2$, and xy for each sample and adding them to an appropriate running sum.

4. A method according to claim 3, wherein a leaky integrator is used to perform the running sum in order to address issues of numerical overflow.

5. A method in accordance with claim 1, wherein the second signal having a bi-directional polar pattern is derived from a first omni-directional microphone and from a second omni-directional microphone, and wherein the first signal having an omni-directional polar pattern is derived from one of the first and second omni-directional microphones.

6. A method according to claim 1, wherein said signal weights are calculated so as to construct an omni-directional combined signal when a total power in said first signal is below a certain value and value a defaults to a value of 1.0 in the event that $\Sigma x^2$ is less than a prescribed minimum value.

7. A method according to claim 5, wherein the omni-directional microphones comprise a front microphone and a rear microphone, and said predetermined direction is the forward direction along the microphone axis.

8. A method according to claim 7, wherein the second signal is provided by the difference between signals produced by the front and rear microphones, without the use of a delay element.

9. A method according to claim 8, further comprising processing the second signal by means of an integrator element or an integrator-like filter before constructing the combined signal, thereby compensating for the attenuation of low frequencies and phase shifts introduced in the subtraction of the two omni-directional signals.

10. A method according to claim 8, further comprising amplifying the signals produced by one or more of the front and the rear microphone before constructing the bi-directional signal, to ensure an equivalent gain between the microphones.

11. A method according to claim 1, wherein said first and second signals are frequency domain samples.

12. A method according to claim 11, further comprising calculating and applying the weights to several independent subsets of frequency domain samples, to give different directional responses at different frequencies and/or to allow selective suppression of different frequencies.

13. A method according to claim 1, comprising applying a frequency weighting function to said first and second signal before calculating said signal weights.

14. An apparatus for producing a combined adaptive directional signal, the apparatus comprising:

an analog-to-digital converter for producing a first sound signal having an omni-directional polar pattern and, a second sound signal having a bi-directional polar pattern;

a summation device for constructing the adaptive directional signal from a weighted sum of a first signal weight of the first signal and a second signal weight of the second signal, wherein the first signal weight and the second signal weight are calculated to give the combined signal a constant gain in a predetermined direction and to minimize power of the combined signal; and means for calculating the weights by solving the following equation:

$$a = \frac{\sum y^2 - \sum xy}{\sum x^2 - 2\sum xy + \sum y^2}$$

where:

a=weight for the first signal (1−a)=weight for the second signal x=first signal sample y=second signal sample.

15. An apparatus according to claim 14, further comprising a first omni-directional microphone and a second omni-directional microphone, wherein the second signal having a bi-directional polar pattern is derived from the first and second omni-directional microphones and wherein the first signal having an omni-directional polar pattern is derived from one of the first and second omni-directional microphones.

16. An apparatus according to claim 14, including means for calculating said signal weights for a series of frames, each frame having a predetermined length consisting of N first signal samples and N second signal samples.

17. An apparatus according to claim 14, including a filter for filtering or smoothing the series of weights to minimize frame-to-frame variation in the calculated weights.

18. An apparatus according to claim 14, including means for calculating said weights continuously for samples of said first and second signals.

19. An apparatus according to claim 14, further comprising leaky integrator to perform a running sum on said first and second signal samples in order to address issues of numerical overflow system memory.

20. An apparatus according to claim 14, further comprising means for calculating said signal weights so as to construct an omni-directional combined signal when a total power in said first signal is below a certain value.

21. An apparatus according to claim 15, wherein the two omni-directional microphones comprise a front microphone and a rear microphone, and wherein said predetermined direction is the forward direction along an axis of the microphones.

22. An apparatus according to claim 21, further comprising means for providing said second signal from the difference between signals produced by the front and rear microphones, without the use of a delay element.

23. An apparatus according to claim 21, further comprising integrator element or an integrator-like filter for processing the second signal before constructing the combined signal, thereby compensating for attenuation of low frequencies and phase shifts introduced in the provision of the second signal.

24. An apparatus according to claim 21, further comprising means for amplifying the signals produced by the front and/or the rear microphone before the step of constructing the bi-directional signal, to ensure an equivalent gain between the microphones.

25. A method according to claim 1, wherein said signal weights are calculated for a series of frames, each frame having a predetermined length comprising of N first signal samples and N second signal samples.

26. A method according to claim 25, wherein N=64.

27. A method according to claim 25, further including filtering or smoothing the series of weights to minimise frame-to-frame variation in the calculated weights.

* * * * *

UNITED STATES PATENT AND TRADEMARK OFFICE

CERTIFICATE OF CORRECTION

PATENT NO. : 8,331,582 B2
APPLICATION NO. : 10/596122
DATED : December 11, 2012
INVENTOR(S) : Brenton R. Steele It is certified that error appears in the above-identified patent and that said Letters Patent is hereby corrected as shown below:

In the Drawings

Figure 2:
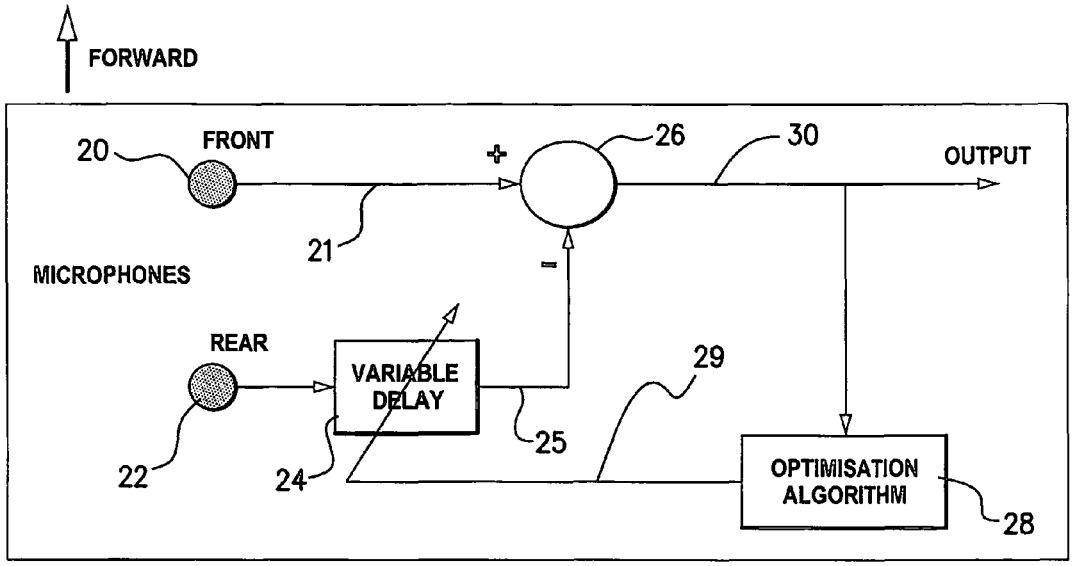
Fig. 2 Prior Art
FIG. 2 is a schematic drawing of an adaptive directional microphone system of the prior art.
Figure 3:
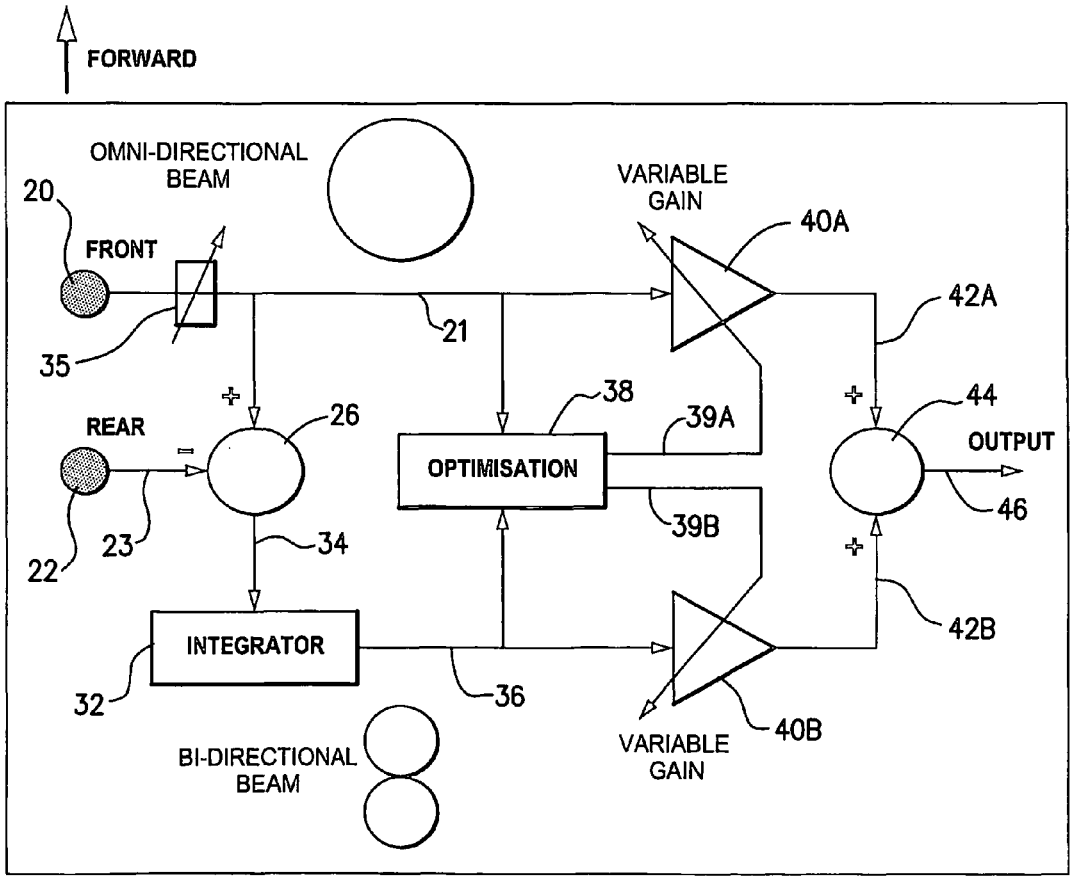
FIG. 3 is a schematic drawing of an apparatus for producing an adaptive directional signal in accordance with an embodiment of the present invention.

| | |
|---|---|
| FIG. 2, Sheet 2 of 4 | Delete Drawing Sheet 2 and substitute therefore the Replacement Sheet consisting of FIG. 2 as shown on the attached page. |

In the Claims

| | |
|---|---|
| Column 10, Claim 1, line 21 | Delete "pattern"<br>Insert -- pattern, -- |
| Column 12, Claim 19, line 15 | After "comprising"<br>Insert -- a -- |
| Column 12, Claim 23, line 32 | After "comprising"<br>Insert -- an -- |

Signed and Sealed this
Second Day of June, 2015

Michelle K. Lee

Michelle K. Lee
*Director of the United States Patent and Trademark Office*